US005314258A

United States Patent [19]

Brown et al.

[11] Patent Number: 5,314,258

[45] Date of Patent: May 24, 1994

[54] SELF-CONTAINED RE-INKING INSERT AND RIBBON CARTRIDGE DEVICE

[76] Inventors: William R. Brown, 36905 SW. Goddard Rd., Cornelius, Oreg. 97113; Don E. Casey, 406 Thurber Dr. West, Ste. 9, Columbus, Ohio 43215

[21] Appl. No.: 938,857

[22] Filed: Aug. 31, 1992

[51] Int. Cl.[5] ..... B41J 31/14

[52] U.S. Cl. ..... 400/202.4; 400/197

[58] Field of Search ..... 400/194, 195, 196, 196.1, 400/197, 200, 201, 202, 202.1, 202.2, 202.3, 202.4, 208

[56] References Cited

U.S. PATENT DOCUMENTS

| | | | |
|---|---|---|---|
| 1,298,045 | 3/1919 | Huddleston | 400/202.4 |
| 1,365,737 | 1/1921 | Simpson | 400/200 |
| 2,104,396 | 1/1938 | Hoppenstand | 400/200 |
| 4,322,172 | 3/1982 | Furrow | 400/202.4 |
| 5,054,943 | 10/1991 | Cheng | 400/202.4 |

FOREIGN PATENT DOCUMENTS

| | | | |
|---|---|---|---|
| 0124278 | 7/1985 | Japan | 400/200 |
| 0234283 | 9/1989 | Japan | 400/202 |

*Primary Examiner*—Edgar S. Burr
*Assistant Examiner*—Ren Yan
*Attorney, Agent, or Firm*—Keith A. Cushing

[57] ABSTRACT

A method and device is shown for converting a conventional printer cartridge into a self-contained re-inking cartridge. A conventional printer cartridge is modified by providing an access hole in its top panel and a re-inking insert is positioned within the access hole. The re-inking insert includes a slit formation allowing passage of the ribbon therethrough. The insert further includes a source of ink and a roller assembly for delivering ink in metered fashion to the ribbon. Thus, under the present invention a wide variety of conventional printer cartridges may be converted, for example by a value-added intermediate manufacturer, into self-inking cartridges having a life span determined by the durability of the ribbon, rather than the ribbon length and ink saturation thereof.

16 Claims, 3 Drawing Sheets

SELF-CONTAINED RE-INKING INSERT AND RIBBON CARTRIDGE DEVICE

BACKGROUND OF THE INVENTION

This invention relates generally to printer ribbon cartridges used for impact computer printers, e.g., daisy wheel or dot matrix printers, and generally to a re-inking device for ribbon cartridges.

Printer ribbon cartridges are typically provided as a disposable product including a given length of pre-inked ribbon. The length of the ribbon defines the useable life of such printer cartridges. Often the usable life is a short life resulting in frequent user dissatisfaction caused by the inability to print long documents without the fading of printed characters, or caused by the necessity of frequent cartridge replacement. It is estimated that up to 26 million impact printers are now in the hands of personal, business, government and military users in the United States alone, with up to 2 million such printers sold annually. Given the vast number of such printers in use, it may be appreciated that ribbon cartridges may be improved by providing a longer cartridge life.

Typical ribbon cartridges include a nylon ribbon, 4 to 5 mils (thousands of an inch) thick, pre-inked at manufacture to a given standard saturation level, typically between 17 and 25 percent. The ribbons are arranged as an endless loop, typically between 5 and 160 feet in length. In basic operation, the ribbon is moved past an exposed portion of the cartridge for impact by the printer head on one side and contact with paper on the other side to form a printed character upon the paper. The cartridge typically includes a mechanical input driven by the printer in order to circulate the ribbon through the cartridge. A good portion of the ribbon is collected within a pocket of the cartridge in generally serpentine configuration. As the cartridge operates, the ribbon is pushed into and drawn from the pocket. Such ribbon cartridges produce good density print when new, but gradually fade during their life span. Such cartridge life spans average 150 pages in the smaller cartridges and up to 300 pages in the larger cartridges. For very long documents, e.g., a doctoral dissertation, an inventory printout, or a book manuscript, printing with a single cartridge can result in significant fading of the printed characters. This fading of characters is apparent by flipping through the pages of the document. Such presentation is undesirable in most instances, especially in formal presentations.

Many attempts have been made to solve such fading problems and associated limited cartridge life problems. Most notable is the separate or external re-inking device which requires ribbon cartridge removal from the printer and mounting of the cartridge upon the separate re-inking device. The re-inking device turns the ribbon through the cartridge and applies a reasonably uniform distribution of ink upon the cartridge. Thus, the external re-inking device includes some mechanical coupling to the printer cartridge in order to draw the ribbon through the cartridge and access the exposed portion in a manner similar to that conducted by the printer, but for the purpose of ink delivery to the cartridge. As may be appreciated, re-inking a cartridge by use of such a separate re-inking device necessarily requires that the ribbon cartridge be taken out of use during re-inking and that sufficient time be allotted to dismount the cartridge from the printer, mount the cartridge to the re-inking device, monitor the re-inking operation, and then re-mount the ribbon cartridge upon the printer for further use. Also, in mounting the cartridge upon the re-inking device the user must thread the ribbon through the re-inking components of the device and must often wear gloves to keep the ink free of their hands.

In other approaches to the problem of limited ribbon cartridge life and ink supply, a re-inking device has been provided as in integral part of the printer cartridge. This has been done b employing a square or rectangular felt or open celled foam rubber pad with a short wick to draw the ink, by capillary action, from the pad onto a roller or gear of the cartridge, which in turn transfers ink onto the passing ribbon. The pad arrangement, however, must be inked to near saturation before the capillary action takes place, and the particulant in the ink causes the cells of the rubber or the passageways of the felt to partially clog. Thus, capillary action alone is insufficient to do the job of delivering ink to the ribbon, and this pad arrangement does not provide any force to feed ink toward the ribbon. Thus, when inked heavily enough to operate properly, such pad arrangement frequently results in ink gravitating toward the passive or active drive gear holes of the cartridge panels and ink undesirably leaks from the cartridge.

U.S. Pat. No. 2,743,470 issued to R. G. Horowitz shows for a typewriter ribbon a cylindric inking pad fed by replenishing ink from a screw-off cap on the top of the device. Such a device, wherein the ribbon enters and leaves this cylinder through two slits and passes against this inked pad, creates the problem of imparting excessive ink against the ribbon if the device is left inside the typewriter, or if the ribbon is stopped while remaining in contact with the pad. It appears that the Horowitz device was designed to be held in place by the operator while the ribbon is manually wound from the feed-spool onto the take-up spool. U.S. Pat. No. 2,441,973 illustrates a device similar to the Horowitz device, with the same deficiencies.

U.S. Pat. No. 3,951,253 shows a self-contained re-inking device designed to attach to a typewriter ribbon spool and to ink the two separate bands on a two color typewriter ribbon. The disclosure of U.S. Pat. No. 3,951,253 shows no provision for preventing excess ink delivery to the ribbon when the ribbon is not in motion. This design would produce what is known as "hot spotting" where the ribbon is overly inked in certain portions and produces non-uniform printing density.

As may be appreciated, a limited life for ribbon cartridges provides an active market for ribbon cartridge manufacturers, but is a source of frustration for users of printer cartridges. More particularly, because the nylon ribbon of most ribbon cartridges is durable enough to withstand 4 or 5 times more printing impact than the supply of ink provided in the ribbon, the ribbon cartridges lack but one component to greatly extend their useful life. It is desirable therefore, that such pre-existing ribbon cartridges be provided with a mechanism for re-inking the ribbon in order to extend the useable life of the cartridge and maintain uniform print density, but not require significant activity on the part of the user in re-inking the cartridge.

SUMMARY OF THE INVENTION

In accordance with a preferred embodiment of the present invention, a self-contained re-inking device may be inserted as a value-added component into a wide variety of pre-existing ribbon cartridges. The insert is provided in the shape of a cylinder, and may be rapidly installed in a printer cartridge by first drilling a hole in the top panel of the cartridge, positioning the insert within the hole while threading the ribbon through the insert, and attaching the device to the body of the cartridge. The insert may be incorporated into pre-existing ribbon cartridges by consumers, but more likely by an intermediate manufacturer which in turn supplies the enhanced ribbon cartridges to consumers.

It is, therefore, an objective of the present invention to provide a value-added component to conventional ribbon cartridges. This value-added component may be incorporated into a wide variety of pre-existing commercial ribbon cartridges to significantly extend the life of such printer cartridges by providing a mechanism for replenishing an ink supply during use of the cartridge. By providing such a replenishing ink supply, gradual fade out of ink density is avoided by allowing the user to simply add ink, or an ink solvent to reactivate any ink already in the cartridge, to maintain a substantially consistent and extended cartridge life printing capability.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
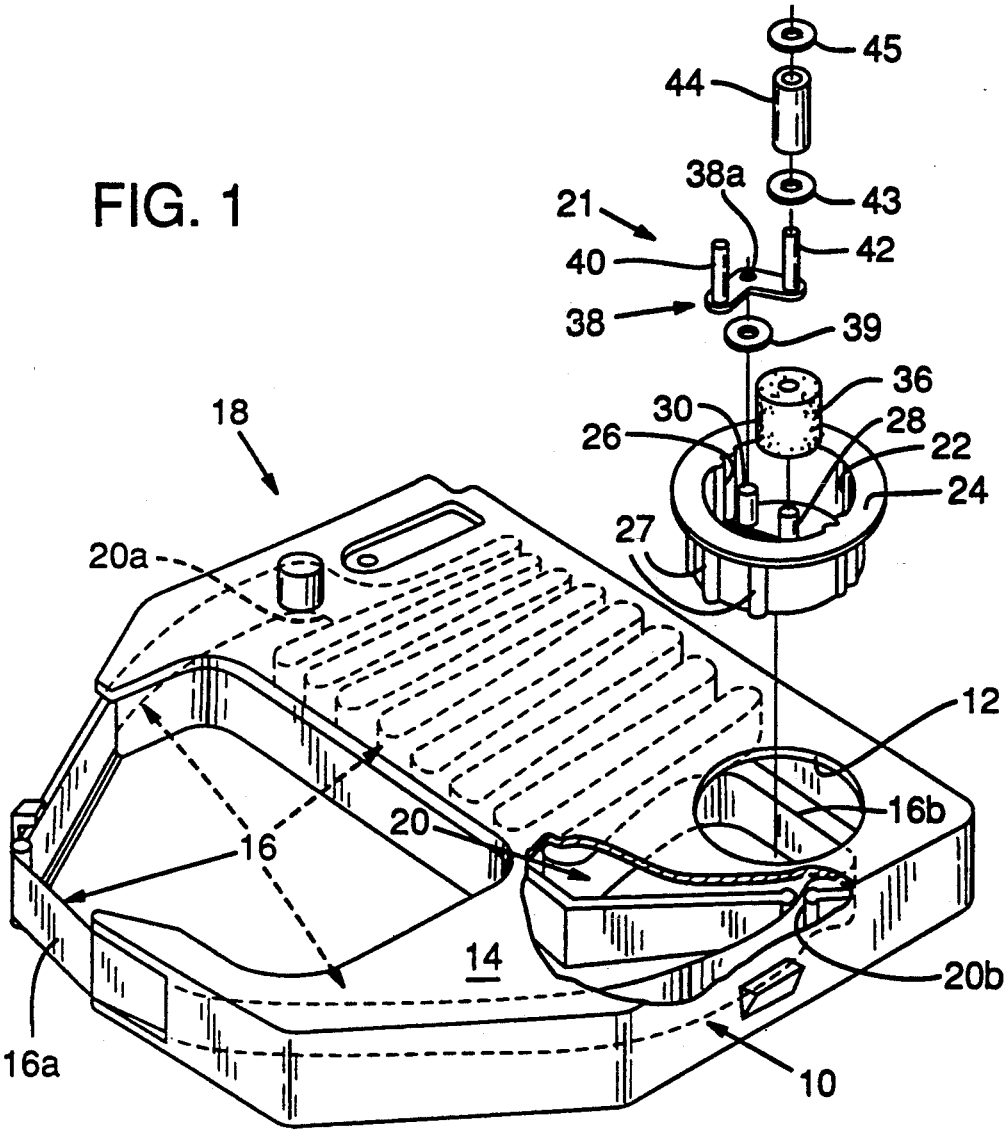
FIG. 1 is a perspective assembly view of the re-inking insert of the present invention and a popular printer ribbon cartridge including an insert access hole provided therein.

FIG. 1 illustrates a conventional printer cartridge 10, but including an insert access hole 12 drilled in the top panel 14 thereof. It is contemplated that the cartridge 10 may be procured from a cartridge manufacturer and converted, by use of the present invention, into a self-contained re-inking printer ribbon cartridge as shown herein. Thus, the cartridge 10 operates generally in conventional manner. A ribbon 16 configured as an endless loop includes an exposed portion **16*a* positioned for contact by the printer head (not shown) and for contact by the paper upon which characters are formed. A drive mechanism 18 receives a mechanical input from the printer in order to draw the ribbon 16 past the printer head such that the entire length of ribbon 16 is exposed to the printer head as the printer operates. A ribbon pocket 20 contains the bulk of ribbon 16 in a generally serpentine configuration. Ribbon 16 is pulled from and pushed into pocket 20 by operation of drive mechanism 18. Thus, as drive mechanism 18 pulls ribbon 16 past the printer head, its output pushes ribbon 16 into the upstream end 20*a* of pocket 20, and pulls ribbon 16 from the downstream end 20*b* of pocket 20**.

In accordance with the present invention, the access hole 12 is drilled near the downstream end **20*b* of pocket 20 to access ribbon 16 thereat. The access hole 12 is drilled only through the top panel 14, without damage to the ribbon 16. It is suggested that this drilling process be accomplished by use of a drill press having limited bit movement coordinated with the position of panel 14 so as to drill only through the panel 14 and not damage the ribbon 16. Hole 12 thereby exposes a ribbon portion 16*b*. A re-inking insert 21 is positioned in the hole 12 and suitably receives the small length, exposed portion 16*b* of ribbon 16 and delivers replenishing ink to the portion 16*b* as ribbon 16 passes through the insert 21 during use of the cartridge 10**.

Because the insert 21 necessarily occupies some space of the pocket 20, it is suggested that a relatively shorter length ribbon be used in conjunction with the re-inking insert 21. Thus, in the process of incorporating the present invention into a pre-existing cartridge a length portion of the ribbon can be removed in order to better accommodate the insert 21. Alternatively, a cartridge manufacturer can provide cartridges with relatively greater free space within the pocket 21 for the purpose of better accommodating an insert 21 under the present invention.

The insert 21 includes a generally cylindric wall 22 surrounded around its upper rim by a flat annular ring or brim 24. At its lower rim insert 21 defines a floor 25. A slit 26 bisects the cylindric wall 22 and the floor 25. The ribbon 16 enters the insert 21 at an upstream slit portion **26*a* formed in wall 22 (FIG. 2) and exits insert 21 at a downstream slit portion 26*b* (FIG. 2) formed in wall 22. The remainder of slit 26 traverses the floor 25 of insert 21. Accordingly, in this embodiment of the present invention the brim 24 maintains each half of the insert 20, i.e., as bisected by slit 26, as an integral unit. On one side of the slit 26 near wall 22 is a large roller post 28 extending upward from the floor 25. A small pivot post 30, on the opposite side of the slit 26 and spaced along the length of slit 26 relative to post 28, also extends upward from the floor 25. The exterior walls of cylindric wall 22 carry vertically oriented ribs 27. The vertical ribs 27 on the outside of the cylinder wall 22 prevent the ribbon 16, as moving within pocket 20, from establishing excess contact with the outside surface of wall 22, which would undesirably result in surface tension or adherence thereto. Thus, the insert 21 defines, when placed within the pocket 20 of cartridge 10, a cavity through which ribbon 16 may pass without interfering with the serpentine arrangement and movement of ribbon 16 through pocket 20**.

The insert 21 is positioned in the hole 12 of the cartridge 10 in such manner to thread a portion 16*b* of the ribbon 16 through the slit 26. It is contemplated that the insert 21 may be attached to the cartridge 10 by sonic welding wherein the downward facing surface 25*a* (FIG. 8) of floor 25 is attached to the upward facing interior surface 15*a* of the bottom panel 15 of cartridge 10. The surface 25*a* of floor 25 should carry a bead about its periphery at manufacture in order to accomplish such sonic welding. Brim 24 should rest upon the upward facing surface 14*a* of panel 14. With the insert 21 so positioned and secured in the cartridge 10, a foam rubber source roll 36 is mounted rotationally on the large post 28. The source roller 36 may be suitably provided by alternate materials, such as tightly wound cloth formed as a roll as well as felt-type material. Also, the source roll 36 need not necessarily be rotationally mounted. A pivot bracket or elbow 38 then rotatably mounts at its aperture 38*a* to the small post 30, including a washer 37 between elbow 38 and floor 25. The pivot elbow 38 carries two upward directed posts 40 and 42. The first post 40 is a guide around which the ribbon 16 may pass. The second post 42 receives a lower washer 43, transfer roller 44 and an upper washer 45 rotatably thereon. The transfer roller 44 may be a length section of rubber tubing, e.g., surgical tubing. The transfer roller 44 need not necessarily be pivotally mounted, i.e., as provided on the elbow 38, and may be held in a stationary position and against the source roll 36.

Figure 2:
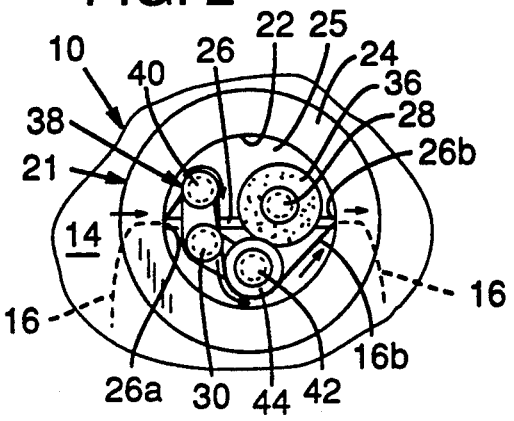
FIG. 2 illustrates the preferred use of the present invention as inserted in the cylinder access hole of FIG. 1 in order to convert the cartridge of FIG. 1 into a self-contained re-inking cartridge in accordance with the present invention.

FIG. 2 illustrates in top view a portion of the completed assembly of the insert 21 and cartridge 10, including the preferred routing of ribbon 16 through insert 21. In FIG. 2, the ribbon portion 16*b* enters the cavity of insert 21 through the upstream portion 26*a* of slot 26. Ribbon 16*b* then passes around the post 40 and from there around the outside surface of transfer roller 44. From transfer roller 44, the ribbon portion 16*b* then exits the cavity of insert 21 through the downstream portion 26*b* of slit 26. In operation, as the ribbon portion 16*b* is pulled through the insert 21, as indicated by the movement arrows of FIG. 2, the transfer roller 44 comes into contact with the source roller 36. With the source roller suitably saturated with replenishing ink, the ink is metered from roller 36 onto the transfer roller 44, and thence onto the ribbon portion 16*b*. Tension in the portion 16*b* of ribbon 16 causes appropriate pivoting of elbow 38 and engagement of the transfer roller 44 and the source roller 36. Source roller 36 is loaded with replenishing ink, or an ink solvent in the event that the ink is partially dried, by merely dropping a small quantity of ink onto the source roller 36.

The transfer roller 44 is thereby maintained in contact with both the source roller 36 and the ribbon portion 16*b* whereby upon movement of the ribbon portion 16*b* through the insert 21 the transfer roller 44 rotates and, because of its frictional engagement with the source roller 36, the source roller 36 rotates. As the source roller 36 and transfer roller 44 move in response to movement of the ribbon portion 16*b*, ink is metered onto the transfer roller 44 and is taken up by the ribbon portion 16*b*.

Figure 3:
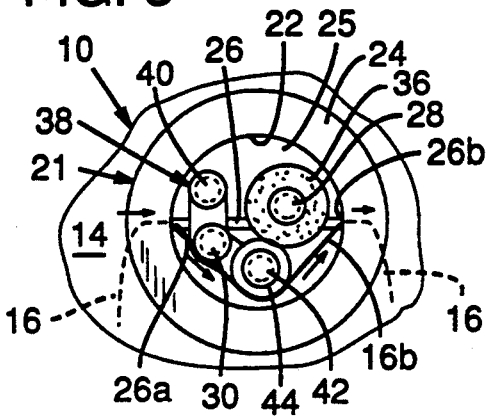
FIGS. 3–5 illustrate alternative ribbon routing arrangements according to variation in a desired ink transfer rate.
Figure 4:
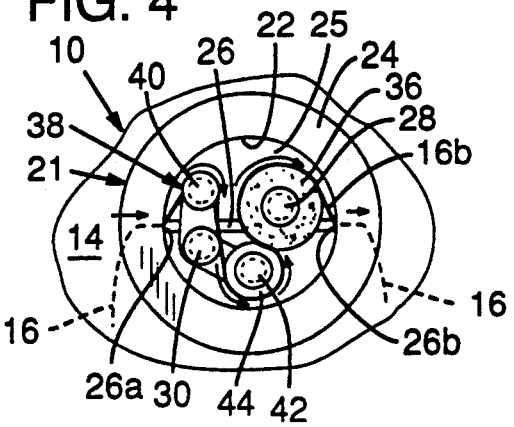
Figure 5:
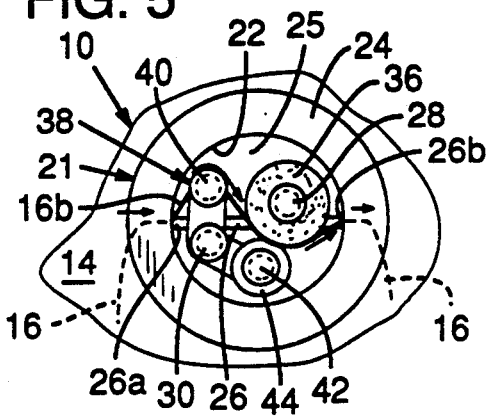

FIGS. 3–5 show alternate routing of the ribbon portion 16*b* through the insert 21. In FIG. 3, the ribbon portion 16*b* pathway is adapted to minimize friction in ribbon travel through the insert 21. In FIG. 3, the ribbon portion 16*b* enters the insert 21 through the upstream portion 26*a* of slit 26, passes around the outside of transfer roller 44, and exits the insert 21 at the downstream portion 26*b* of slit 26. When the printer ribbon cartridge 10 operates, tension in the ribbon 16 will urge the transfer roller 44 against the source roller 36. As the ribbon portion 16*b* moves through the insert 21, the rollers 44 and 36 rotate to meter ink from roller 36 to roller 44 and thence to ribbon portion 16*b*.

The ribbon pathway shown in FIG. 3 produces less drag on ribbon travel and is preferred when the insert 21 is installed in ribbon cartridges wherein the passive gear (not shown) exerts less than the desired pressure against the drive gear (not shown). The ribbon pathway of FIG. 3 is less desirable than that of FIG. 2 because the transfer roller 44 exerts less pressure against the source roller 36, resulting in a slower ink transfer rate. However, with the application of a thinning agent to the ink, either mixed with the ink beforehand or applied directly onto the source roller 36 just before operation, the transfer of ink to the ribbon portion 16*b* can be acceptable.

FIG. 4 shows a threading pathway for ribbon portion 16*b* intended for the maximum transfer rate of ink onto the ribbon 16. In this arrangement, maximum leverage is created to press the transfer roller 44 against the source roller 36, however, the ribbon portion 16*b* is reversed in direction and also wraps back around the source roller 36 prior to exiting the insert 21. More particularly, the ribbon portion 16*b* enters the upstream portion 26*a* of slit 26, passes around the outside of transfer roller 44 and through the nip of roller 44 and roller 46, and finally around the outside of source roller 36 and through the downstream portion 26*b* of slit 26. This routing arrangement is recommended when printing successive full page graphics or banners which require the highest possible ink transfer rate. An objection to this threading arrangement in ordinary use is that the ribbon portion 16*b* remains in contact with the source roller 36, and excessive ink delivery to limited portions of the ribbon portion 16*b* can result, i.e., "hot spotting" can result. It is contemplated, therefore, that such a ribbon pathway would be only temporarily implemented during times when a high ink transfer rate is desired.

FIG. 5 shows a ribbon threading arrangement wherein the user desires a higher than ordinary rate of ink transfer onto the ribbon portion 16*b*, though not as high a transfer rate as provided by the arrangement of FIG. 4. For example, the ribbon pathway of FIG. 5 might be appropriate where a large number of full page numerical printouts are required. In FIG. 5, the ribbon portion 16*b* enters the insert 21 through the upstream portion 26*a* of slit 26, passes around guide posts 40, and then passes directly between the nip of rollers 44 and 36. From the nip of rollers 44 and 36, ribbon portion 16*b* continues along roller 36 then exits insert 21 at the downstream portion 26*b* of slit 26.

Also shown in FIGS. 2–5 is one suggested method of securing the various rollers and components upon the posts of the insert 21. More particularly, each of the posts 28, 30, 40, and 42 can be "mushroomed" to form a cap at the distal end thereof for securing the corresponding components of roller 36, elbow 38, ribbon portion 16*b*, and roller 44, respectively. As may be appreciated, a great variety of equally suitable methods of securing such components on the various posts of the illustrated embodiment may be employed. For example, FIG. 8 illustrates an alternative mechanism for securing the roller 36 upon the post 28.

Figure 6:
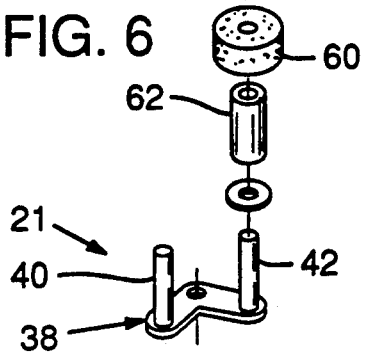
FIG. 6 shows an alternative configuration of the present invention adapted for use in selective re-inking of a given color band on a multi-color printer ribbon cartridge.

FIG. 6 shows a portion of the insert 21 as adapted for multicolored ribbons. In FIG. 6, the transfer roller 44 is replaced with a shorter transfer roller 60 and a standoff spacer 62, both rotatably mounted upon the post 42 of elbow 38. By suitably dimensioning the length of roller 60 and standoff spacer 62, the position and size of transfer roller 60 may be coordinated with a given color band of a multi-color printer ribbon. Typically, one color is used more frequently than other colors of the multi-color ribbon. The life span of a conventional multi-color cartridge is limited to the life span, i.e., ink supply, of the most frequently used color band, the remaining bands are not completely used. For example, it is typical for a black color band to run out of ink before the other color bands. Accordingly, the transfer roller arrangement of FIG. 6 may be used to selectively re-ink one of the color bands, e.g., the black color band, of a multi-color ribbon cartridge. In this manner, the life span of the multi-color ribbon cartridge is not limited to the link capacity of the most frequently used color band.

Figure 7:
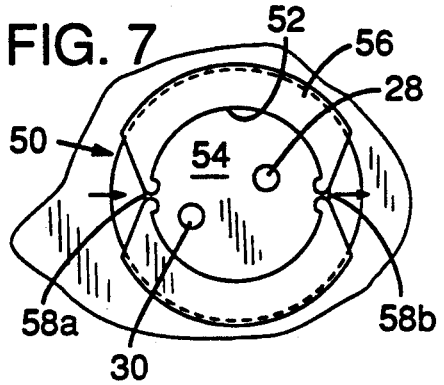
FIG. 7 shows a top view of an alternate configuration for the insert of the present invention.

FIG. 7 illustrates an alternative configuration for the insert 21. In FIG. 7, an insert 50 is defined by a cylindric wall 52 and a floor 54. The upper rim of cylindric wall 52 carries a flat annular ring or brim 56. Vertical slots 58*a* and 58*b* are provided in the wall 52 at the upstream and downstream, respectively, sides of the insert 50. In the vicinity of each of slots 58*a* and 58*b*, the brim 56 is cutaway in a wide V-shaped notch. The floor 54 of insert 50 is continuous and carries the posts 28 and 30 for operation in a manner similar to the insert 21 of FIG. 1. Insert 50 differs, however, with respect to its mounting to cartridge 10. More particularly, once the access hole 12 is drilled into the top panel 14 of the cartridge 10, the ribbon portion 16*b* is pulled out of cartridge 10 through the access hole 12. The insert 50 is then positioned in the hole 12 with the upstream and downstream ends of ribbon portion 16*b* passing through the notch formations adjacent the slits 58*a* and 58*b*, respectively. By making the diameter of cylindric wall 52 less than the diameter of hole 12, such mounting of insert 50 is made easier. As secured in cartridge 10, the ribbon portion 16*b* rests within slots 58*a* and 58*b* for passage through insert 50.

Figure 8:
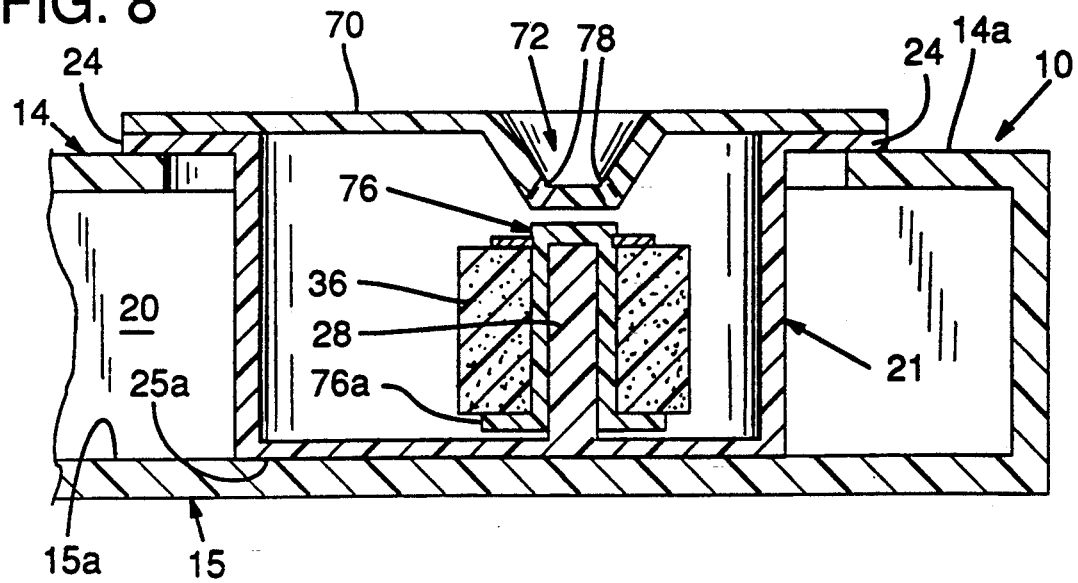
FIG. 8 illustrates an enhancement applicable to the previously described embodiments of the present invention wherein a funnel formation is used to deliver ink from outside the cartridge to a source roll of the re-inking insert.

FIG. 8 illustrates an enhancement applicable to the previously described embodiments of the present invention. In FIG. 8, the insert 21 is shown in section through the transfer roller 36. A cap 70 is attached to the brim 24 of insert 21 and includes an ink delivery funnel formation 72. The funnel formation 72 provides a means for delivering known quantities of ink to the source roller 36. A closed-end rivet 76 rests concentrically on the post 28 with the flange portion 76*a* of rivet 76 supporting the roller 36. The source roller 36 then mounts concentrically upon the cylindric portion of rivet 76. In this configuration, the bearing surface by which roller 36 rotates relative to the post 28 is provided between the top of post 28 and the interior downward-facing surface of the rivet 76. As may be appreciated, this bearing portion of the assembly is substantially isolated from the ink supply of the source roller 36 and is thereby not affected by dried ink thereon. A clip 74 secures the roller 36 upon the rivet 76.

The funnel formation 72 of cap 70 rests concentrically at the top of source roller 36 and includes conduits 78 fluidly coupling the funnel 72 and the source roller 36. In operation, a user need only deliver several drops of ink, or ink solvent, into the funnel formation 72 in order to replenish the ink reservoir, i.e., source roller 36. Because the funnel formation 72 delivers ink directly to the supply roller 36, the user is not likely to inadvertently deliver ink to other portions of the cartridge 10 and thereby contaminate such portions of cartridge 10 with excessive ink. Such excessive ink can either clog the mechanical portions of the cartridge 10, or can leak out of cartridge 10 and contaminate the printer mechanism. The size of funnel formation 72 thereby provides a reference to the user for providing a known or consistent quantity of ink. In this manner, the experienced user can suitably re-ink the cartridge 10 without over-inking or under-inking the source roller 36. The cap 70 could be permanently mounted to the insert 21, or removably mounted whereby the user could remove cap 70 in order to accomplish re-routing of the ribbon portion 16*b* through the insert 21 as described above in connection with FIGS. 2-5.

Figure 9:
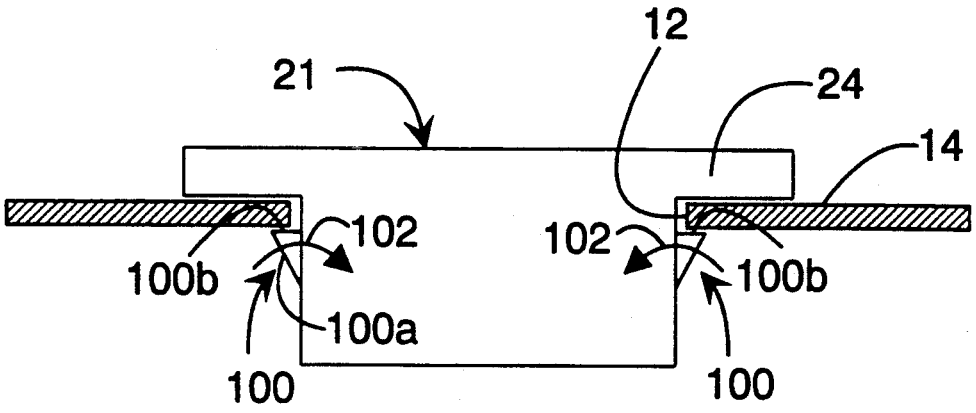
FIG. 9 shows a re-usable re-inking insert according to one alternative embodiment of the present invention.

FIG. 9 illustrates another variation which may be applied to the re-inking insert 21. In FIG. 9 the insert 21 is shown including resilient clip elements 100. Each clip element 100 includes a sloped surface 100*a* and a flat surface 100*b*. The flat surface 100*b* is substantially parallel to and spaced from the undersurface of brim 24. The spacing between brim 24 and surface 100*b* is sufficient to accommodate the thickness of panel 14 of cartridge 10. The clip elements 100 move inward as indicated by arrows 102 as the insert 21 is placed in the access hole 12 of panel 14. Once the brim 24 engages the top surface of panel 14, the clips 100 then return to their natural position and secure the insert 21 within the access hole 12 of cartridge 10. Additional apertures (not shown) in brim 24 would provide access to elements 100 for detaching insert 21. Thus, the embodiment shown in FIG. 9 is a re-usable self-inking insert for a printer cartridge. Because the insert 21 is likely to outlast the ribbon of a given cartridge, it is desirable that the insert 21 be then removed from the spent cartridge and used in a second such printer cartridge. In this manner, the life of insert 21 is determined by the durability of its components, rather than the durability of the ribbon with which it is used.

The re-inking device according to the present invention can increase the expected life time for a conventional printing cartridge by a factor of up to five. More particularly, a typical cartridge can print 200 to 400 pages, but when equipped with a re-inking device of the present invention can print up to 1,000 pages, and possibly as many as 1,500 to 2,000 pages.

It will be appreciated that the present invention is not restricted to the particular embodiments that have been described and illustrated herein, and that variations may be made therein without departing from the scope of the invention as found in the appended claims and equivalence thereof.

What is claimed is:

1. In combination a re-inking insert and a pre-existing printer-ribbon cartridge, the cartridge including an endless ribbon configuration and a pocket portion within the cartridge through which said ribbon traverses in operation, said insert comprising:

a wall defining a cavity of said insert, said wall including a side wall portion and a floor portion whereby said cavity may be placed within said pocket and slit formations in both side wall portion and said floor portion allowing a portion of said ribbon to pass into and through said cavity through said floor portion during insertion of said insert into said pocket portion and through said side wall portion during operation of the ribbon cartridge;

an ink source within said cavity; and an ink transfer mechanism within said cavity coupling said ink source and said portion of said ribbon passing through said cavity whereby said ribbon may receive a replenishing ink supply during use of said ribbon cartridge.

2. An insert according to claim 1 wherein said ink source is a foam rubber rotatably mounted within said cavity of said insert.

3. An insert according to claim 1 wherein said transfer mechanism comprises a roller rotatably mounted within said cavity of said insert and positioned for engagement by said ink source and engagement by said ribbon portion passing through said cavity of said insert.

4. An insert according to claim 1 wherein said ink source is a foam rubber roller rotatably mounted within said cavity of said insert and said ink transfer mechanism is a transfer roller rotatably mounted within said cavity of said insert and in frictional engagement with said foam rubber roller and in contact engagement with said portion of said ribbon passing through said cavity of said insert whereby upon movement of said ribbon through said insert said transfer roller rotates and causes rotation of said foam rubber roller whereby ink is metered from said foam rubber roller onto said transfer roller and then onto said portion of said ribbon passing through said cavity of said insert.

5. An insert according to claim 1 wherein said ink transfer mechanism comprises:

an elbow bracket pivotally mounted within said cavity to said floor portion and including an upward extending guide post and an upward extending transfer roller post; and a transfer roller rotatably mounted upon said transfer roller post of said elbow bracket whereby upon contact with said portion of said ribbon passing through said cavity of said insert said transfer roller rotates.

6. An insert according to claim 5 wherein said ink source comprises a foam rubber roller positioned for frictional engagement by said transfer roller of said ink transfer mechanism.

7. An insert according to claim 1 wherein said re-inking insert includes resilient clip portions for releasably attaching to said cartridge whereby said re-inking insert may be temporarily mounted to said cartridge for use in conjunction with said cartridge and later dismounted from said cartridge by deformation of said clip portions for attachment to a second cartridge.

8. An insert according to claim 1 wherein said insert further comprises a cap formation attachable to an open end of said cavity to substantially close said cavity, said cap formation including a funnel formation including apertures for delivering ink deposited in said funnel formation to said ink source within said cavity.

9. A re-inking insert in combination with a pre-existing printer-ribbon cartridge, the cartridge including an endless ribbon configuration and a pocket portion through which said ribbon traverses in operation, said insert comprising:

a wall defining a cavity of said insert, said wall including a side wall portion and a floor portion, said cavity may be interposed within said pocket and slit formations in both said side wall portion and said floor portion for allowing said ribbon to pass into and through said cavity through said floor portion during insertion of said insert into said pocket portion and through said wall portion during operation of the ribbon cartridge;

an ink source within said cavity;

an ink transfer mechanism carrying ink from said ink source to said portion of said ribbon passing through said cavity when said ribbon is moving through said cavity, and not carrying ink from said ink source to said portion of said ribbon passing through said cavity when said ribbon is not moving through said cavity whereby said ribbon may receive a replenishing ink supply during use of said ribbon cartridge; and mounting structure of said insert allowing said insert to be placed within said pocket and attached to said cartridge.

10. An insert according to claim 9 wherein said ink source is a foam rubber roller rotatably mounted within said cavity of said insert.

11. An insert according to claim 9 wherein said transfer mechanism comprises a roller rotatably mounted within said cavity of said insert and positioned for engagement by said ink source and engagement by said ribbon portion passing through said cavity of said insert.

12. An insert according to claim 9 wherein said ink source is a foam rubber roller rotatably mounted within said cavity of said insert and said ink transfer mechanism is a transfer roller rotatably mounted within said cavity of said insert and in frictional engagement with said foam rubber roller and in contact engagement with said portion of said ribbon passing through said cavity of said insert whereby upon movement of said ribbon through said insert said transfer roller rotates and causes rotation of said foam rubber roller whereby ink is metered from said foam rubber roller onto said transfer roller and then onto said portion of said ribbon passing through said cavity of said insert.

13. An insert according to claim 9 wherein said ink transfer mechanism comprises:

an elbow bracket pivotally mounted within said cavity to said floor portion and including an upward extending guide post and an upward extending transfer roller post; and a transfer roller rotatably mounted upon said transfer roller post of said elbow bracket whereby upon contact with said portion of said ribbon passing through said cavity of said insert said transfer roller rotates.

14. An insert according to claim 13 wherein said ink source comprises a foam rubber roller positioned for frictional engagement by said transfer roller of said ink transfer mechanism.

15. An insert according to claim 9 wherein said re-inking insert includes resilient clip portions for releasably attaching to said cartridge, said clip portions establishing temporary mounting to said cartridge by engaging resilient portions of said cartridge for use in conjunction with said cartridge and later dismounting from said cartridge by deformation of said clip portions for attachment to a second cartridge.

16. An insert according to claim 9 wherein said insert further comprises a cap formation attachable to an open end of said cavity to substantially close said cavity, said cap formation including a funnel formation including apertures for delivering ink deposited in said funnel formation to said ink source within said cavity.

* * * * *

UNITED STATES PATENT AND TRADEMARK OFFICE

CERTIFICATE OF CORRECTION

PATENT NO. : 5,314,258

DATED : May 24, 1994

INVENTOR(S) : William R. Brown, et al

It is certified that error appears in the above-indentified patent and that said Letters Patent is hereby corrected as shown below:

Column 8, line 65, insert --said-- after both;

Column 9, line 10, insert --roller-- after rubber.

Signed and Sealed this

Sixteenth Day of August, 1994

*Attest:*

*Attesting Officer*

Bruce Lehman

BRUCE LEHMAN

*Commissioner of Patents and Trademarks*